United States Patent [19]

Stecker

[11] Patent Number: 4,490,244

[45] Date of Patent: Dec. 25, 1984

[54] PRODUCTION OF PREMIUM GRADE PETROLEUM COKE

[75] Inventor: Glenroy Stecker, Johnson City, Tenn.

[73] Assignee: Great Lakes Carbon Corporation, New York, N.Y.

[21] Appl. No.: 534,489

[22] Filed: Sep. 21, 1983

Related U.S. Application Data

[63] Continuation-in-part of Ser. No. 427,706, Sep. 29, 1982, abandoned.

[51] Int. Cl.[3] ..... C10G 9/14

[52] U.S. Cl. ..... 208/131

[58] Field of Search ..... 208/131; 252/502

[56] References Cited

U.S. PATENT DOCUMENTS 3,896,023 7/1975 Ozaki et al. ..... 208/50 X 4,043,898 8/1977 Kegler ..... 208/50

OTHER PUBLICATIONS

J. K. Brown, W. R. Ladner, "Fuel", 39, 87 (1960).

*Primary Examiner*—Delbert E. Gantz

*Assistant Examiner*—Glenn A. Caldarola

*Attorney, Agent, or Firm*—Adrian J. Good

[57] ABSTRACT

Graphite having a coefficient of thermal expansion of less than $5\times10^{-7}$ cm/cm/°C. over the range of 0°-50° C. is produced from premium petroleum cokes. The cokes are produced from feedstocks selected and blended on the basis of high resolution nuclear magnetic resonance spectroscopy of the hydrogen atoms in the raw material and multiple linear regression analysis of the various NMR bands as applied to a statistically significant number of feedstocks known to produce premium needle cokes together with a variable relating to thermal reactivity used to derive a predictive equation for the coefficient of thermal expansion.

7 Claims, 3 Drawing Figures

PRODUCTION OF PREMIUM GRADE PETROLEUM COKE

This application is a continuation-in-part of application Ser. No. 427,706, filed Sept. 29, 1982, now abandoned.

FIELD OF THE INVENTION

This invention relates to the production of what is known as a premium coke suitable for the production of graphite having a low coefficient of thermal expansion (CTE).

For many years, the bulk of the synthetic graphite produced worldwide has used calcined petroleum coke as the principal raw material, and a principal use of graphite has been in electrodes for the arc furnace melting of steel. In the U.S. during 1970, approximately 20 million tons of steel, representing 15% of the total, was produced in electric arc furnaces. This increased to 31 million tons in 1980, 20% of the total steel produced that year, and it is projected that by 1985 over 30% of the total steel production will be in electric arc furnaces.

This increase in usage of the electric arc furnace has strained the capacity of the electrode industry and the supplies of high quality petroleum coke.

The petroleum coke used as raw material for large graphite electrodes is premium needle coke, having an acicular crystalline structure and a graphite CTE characteristic of less than $5\times10^{-7}$ cm/cm/°C. over the range of 0° to 50° C. as determined in a standardized test method. It is produced by delayed coking of selected petroleum residues, such as catalytic slurry oils, thermal tars including residual tars from cracking to produce ethylene and similar aromatic materials. The raw coke is calcined at about 1000° to 1500° C. in a rotary kiln. After calcining, the coke is screened; and selected size fractions are combined, wet with a binder, generally coal tar pitch, shaped into electrodes, and baked and graphitized.

Due to the price increases of the past few years, it has become imperative that the production of needle coke be put on the most economical base possible, which includes the selection of the most advantageous raw materials and their blending or pre-coker treatment in order to maximize the yield of high quality needle coke at the lowest possible price.

DESCRIPTION OF THE PRIOR ART

The art of producing needle coke from petroleum based residues is broadly based on the disclosure of U.S. Pat. No. 2,775,549, Shea, Dec. 25, 1956. The selection of raw materials by aromaticity is disclosed in U.S. Pat. No. 3,896,023, Ozaki et al. and U.S. Pat. No. 4,043,898, Kegler. Brown and Ladner in *Fuel,* Vol. XXXIX, January 1960, p. 87–96, published a study of the hydrogen distribution in coal-like materials by high resolution NMR spectroscopy. Seshadri, Albaugh and Bacha in *Preprints,* Div. Petroleum Chem., ACS, Vol. 26, No. 2, March 1981, pp. 526–37, published a study of the compositional differences between decant oil and pyrolysis tar as related to coking characteristics.

SUMMARY OF THE INVENTION

The CTE characteristics of delayed petroleum cokes produced from catalytic slurry oil feedstocks or a blend of selected aromatic petroleum fractions of the type described herein, are predicted from high resolution NMR spectroscopy analysis of the feedstock and CTE's of laboratory cokes, using multiple linear regression analysis. The CTE's of cokes made with other feedstocks may also be predicted by the inclusion of data for other parameters.

Thermal tar, a residue obtained in the thermal cracking of distillate fractions in the petroleum refinery, such as virgin or cracked gas oils, has been the preferred feedstock for the production of premium coke. Increased demand and changes in refinery practice have made it necessary to develop other feedstocks for this purpose. Decanted slurry oils from the catalytic cracking of gas oils and ethylene pyrolysis tars are now used extensively. Unfortunately, a knowledge of the source and processing variables is not always adequate to qualify a feedstock for production of premium grade coke. It is normal practice to evaluate a feedstock in the laboratory by coking in a bench scale or pilot scale coker, followed by calcination of the coke, fabrication of small extruded rods from a mixture of the coke with coal tar pitch binder and a puffing inhibitor (optional), baking and graphitization of the rods, and finally measurement of the axial CTE of the graphite rods. This procedure requires a minimum elapsed time of one week and is necessarily quite expensive. It would be highly desirable from both a time and cost standpoint, to develop a procedure that would predict the CTE of a delayed coke from an easily measured feedstock property. Many attempts have been made to predict coke CTE from feedstock properties. Keglar, supra, teaches that an aromaticity characterization index, known as the Bureau of Mines Characterization Index (BMCI), has been found to reliably predict product (coke) quality. BMCI is calculated from the average volumetric boiling point of the feedstock and its specific gravity (or API gravity). While API gravity is an easily measured property, the volumetric average boiling point requires that a distillation test be conducted. Such distillation tests require several hours to conduct, including preparation and cleaning of the distillation equipment, and reproducible results are difficult to obtain by any but the most experienced operators. Furthermore, correlation of CTE with BMCI does not appear to be as good as with the method of the present invention.

Prior to and in conjunction with the experiments which led to the present invention, attempts were made to correlate coke CTE with the structural parameters of feedstocks as developed by Brown and Ladner, supra. The Substitution Index, defined as the degree of substitution of the aromatic systems, i.e., the fraction of the aromatic edge atoms occupied by substitutes, was found to correlate well with coke CTE over a wide range of CTE values (CTE=0.0 to $20\times10^{-7}$/°C.), but was not sufficiently useful over the narrow range of CTE values represented by premium grade cokes (CTE=0.0 to $6.0\times10^{-7}$/°C.). Calculation of the Substitution Index requires nuclear magnetic resonance (NMR) proton analysis and elemental analysis of carbon and hydrogen. NMR proton analysis is very rapid, requiring 5 to 10 minutes, while C and H analyses (combustion train) require several hours.

According to the present invention, the CTE of delayed petroleum cokes produced from feedstocks known as catalytic slurry oils (S.O.) or ethylene tars (E.T.) can be predicted with a high degree of confidence from high resolution NMR proton analysis of the feedstock. The equations enabling the prediction of coke CTE are generated from NMR analyses of feedstock samples and the CTE values of laboratory cokes by the statistical technique of multiple linear regression analysis. Expansion of the method of this invention to feedstocks other than catalytic slurry oils requires the determination of additional feedstock properties. Success has been obtained with samples of ethylene tar, using rate of quinoline insoluble matter formation in addition to NMR analyses, in multiple linear regression analysis.

DETAILED DESCRIPTION OF THE INVENTION

Figure 1:
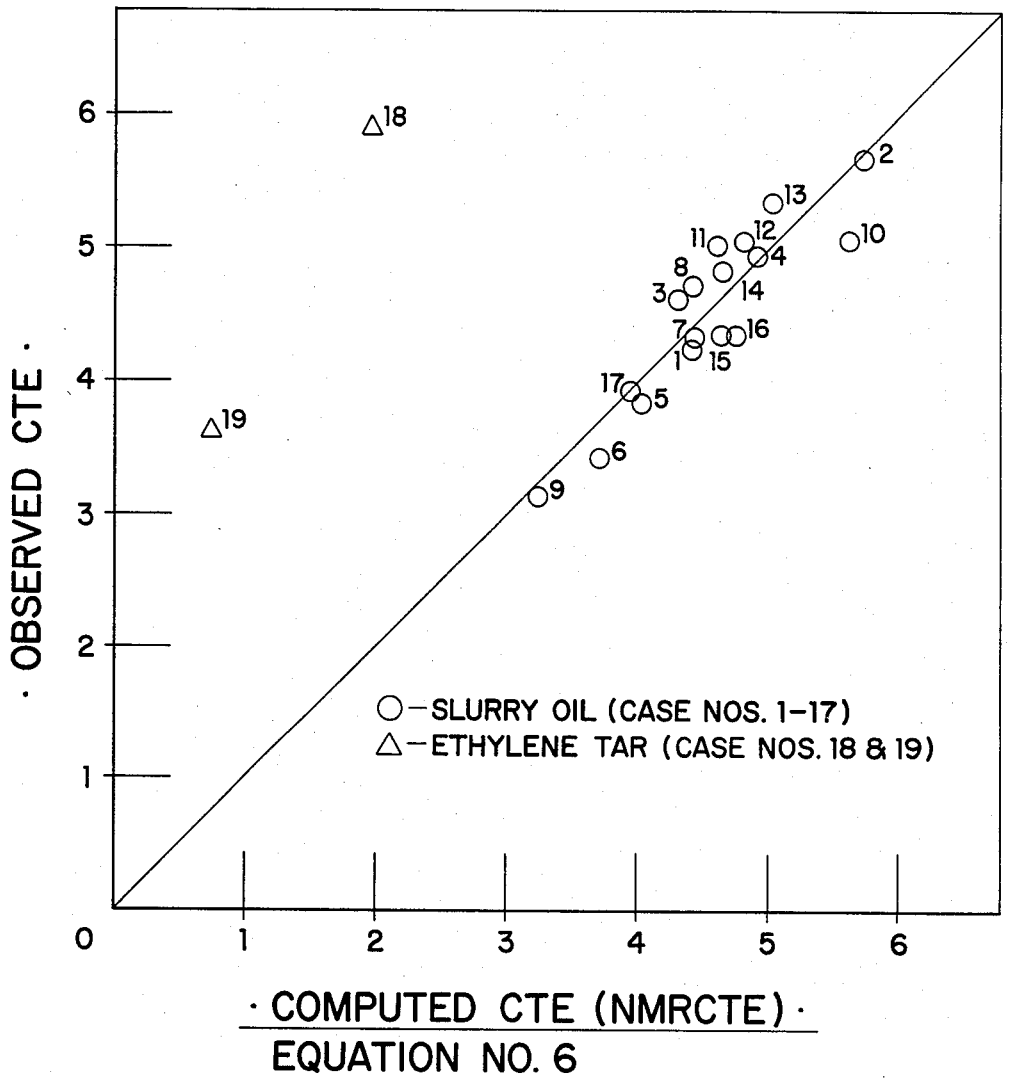
FIG. 1 shows the correlation of observed CTE with computed CTE (NMRCTE) using equation 6, for selected slurry oils and ethylene tars.

Definition of Variables. The dependent variable used in the regression analysis technique of the invention is defined as the coefficient of thermal expansion (CTE), over the range of 0° to 50° C., of graphite rods fabricated from laboratory coke, using 2 pph iron oxide as a puffing inhibitor. A CTE value of 3.4 is understood to mean thermal expansion of $3.4\times10^{-7}$ per degree C. in the extrusion direction. The independent variables are several analyses, properties, and calculated structural parameters of the feedstocks from which the laboratory cokes were made. The percentages of total hydrogen in five proton NMR bands were initially treated as independent variables. AR1 denotes aromatic hydrogen atoms of the polycyclic type, primarily "bay protons". AR2 denotes aromatic hydrogens of the benzenoid type. AL1, AL2, AL3 denote aliphatic hydrogens of the benzylic, methylene, and methyl types, respectively, or $\alpha$H, $\beta$H, and $\gamma$H in the conventional NMR terminology. FA is the Aromaticity, and SIGMA is the Substitution Index, structural parameters calculated from NMR and carbon/hydrogen analyses by methods described by Brown and Ladner. SUS is viscosity in Saybolt Universal Seconds at 99° C. (210° F.). QI2 is the rate of formation of quinoline insoluble material (QI), expressed as percent of QI in the feedstock after heat treating at 450° C. for 2 hours.

NMR analyses of the feedstocks were made using a JEOL-C60H high resolution NMR spectrometer. Carbon and hydrogen were analyzed by combustion of feedstock samples in an oxygen atmosphere. Coking was conducted batchwise in steel pots at atmospheric pressure under carefully controlled conditions. Preparation of CTE rods was by standard methods. Measurement of CTE was conducted over the 0° to 50° C. range.

Data for 17 slurry oil feedstocks and 2 ethylene tars are presented in Table I. CTE, NMR analyses (AR1, AR2, AL1, AL2, and AL3), SUS, and NMRCTE (to be defined below) are tabulated for all 19 feedstocks, while C/H (atomic carbon/hydrogen ratio) and the calculated structural parameters FA and SIGMA were determined only for Case Nos. 1-9. QI2 values were determined only for Case Nos. 3, 5, 6, 9, 13, 14, 18, and 19. Three data bases were used in the regression analysis as described at the bottom of Table I.

Table II presents the simple descriptive statistics and the bivariate correlation matrix for CTE and the 5 NMR variables from Data Base I (17 catalytic slurry oils). In general, bivariate correlations among the five NMR variables are quite good, but no significant bivariate correlation exist between CTE and any of the NMR variables. However, highly significant correlations were obtained by the technique of multiple linear regression analysis, as illustrated in Table III. Correlation was poor when the E.T. samples were included but excellent when they were removed from the data base. Matrix difficulties precluded the calculation of a meaningful equation with all five NMR bands as independent variables. When any four of the five were used, five highly significant equations (Equation Nos. 1 to 5) were generated. The Coefficient of Correlation, R, was 0.9060 for all five equations, the statistical Significance Level was 99.98%, and the Standard Error of Estimate (of computed CTE using the regression equation) was 0.3262. The numbers in parentheses under each regression equation are the significance levels, in percent, of the intercept and each coefficient in that equation. It will be observed that in each equation in which both AR2 and AL3 appear, they dominate the equation.

Equation No. 6 represents the best of the ten possible combinations of three NMR bands, and Equation No. 7 the best of ten possible combinations of two NMR bands. Equation No. 6 was used to calculate the new variable, NMRCTE, which is listed for each feedstock in the last column of Table I. NMRCTE is the only independent variable appearing in Equation No. 8. The Standard Error of Estimate is less than that listed in Equation No. 6 as a consequence of combining three variables into one, thus increasing the number of degrees of freedom available to the error sum of squares.

The structural parameters aromaticity (FA) and the Substitution Index (SIGMA) of Brown and Ladner have been proposed as useful in evaluation of coking feedstocks. Carbon and hydrogen analyses, in addition to NMR analyses, were required to calculate these parameters for Case Nos. 1 to 9 (Data Base II). The superiority of NMRCTE over both FA and SIGMA for evaluation purposes is clearly illustrated in Table IV (Equation Nos. 9 to 12).

Referring again to Table I (and to FIG. 1), Case Nos. 18 and 19 are ethylene tars from two refineries. It will be noted that while one of the tars may be considered a premium feedstock (Case No. 19, CTE=3.7), and the other is marginal (Case No. 18, CTE=6.0), the computed CTE's using NMR analyses alone from a slurry oil data base are significantly lower than the observed CTE's of the laboratory cokes (NMRCTE=1.92 and 0.75, respectively). It has been observed that the ethylene tars differ from the slurry oils in two important respects; (1) the tars are significantly more viscous than the slurry oils, and (2) the tars tend to form mesophase material (optically active liquid crystals) at a lower temperature, and of significantly smaller size and greater number, than is the case with slurry oils. It is further anticipated that other properties associated with either rheology in the coking operation or propensity for the formation of low-temperature, small-domain mesophase may serve as useful correction variables in regression equations. Examples of the latter category might be solubility of the tar in various solvents or blends of solvents such as used in deasphalting processes.

The coefficients in Equation 12 (Table IV) are different from those in Equation 8 (Table III) since the NMR CTE variable generated in Table III from 17 slurry oils was used in Table IV with a partial data base (9 of the 17 slurry oils).

A more detailed study was made of seven slurry oils, seven ethylene tars, and two mixtures, with data shown in Table V. In this table, data from six of the slurry oils and two of the ethylene tars for which the QI2 figures were available were carried over from Table I with the original numbers in parentheses.

Five additional slurry oils were included to achieve a more representative data base, and a seventh slurry oil was included since it had been used in mixtures with an E.T.

Table VI presents four regression equations in which coke CTE is correlated with NMR analysis alone and in combination with ET, SUS, and QI2. The NMR analyses were combined into single variables as shown in Table VII to enable the computer program to assign a more realistic distribution of degrees of freedom in the analysis of variance. Statistical significance levels associated with the intercept and the coefficients of each equation are shown in parentheses.

In the study below, the correction factors ET, SUS, and QI2 were evaluated. ET was helpful, but not as good as QI2, and SUS was not helpful.

Multiple linear regression analysis produced excellent correlation of lab coke CTE with two feedstock characteristics for a group of coker feedstocks comprising catalytic slurry oils, ethylene tars, and blends of the two. The feedstock characteristics used as independent variables in the preferred regression equation were proton NMR analysis and quinoline insoluble content after a two-hour heat treatment at 450° C.

Figure 2:
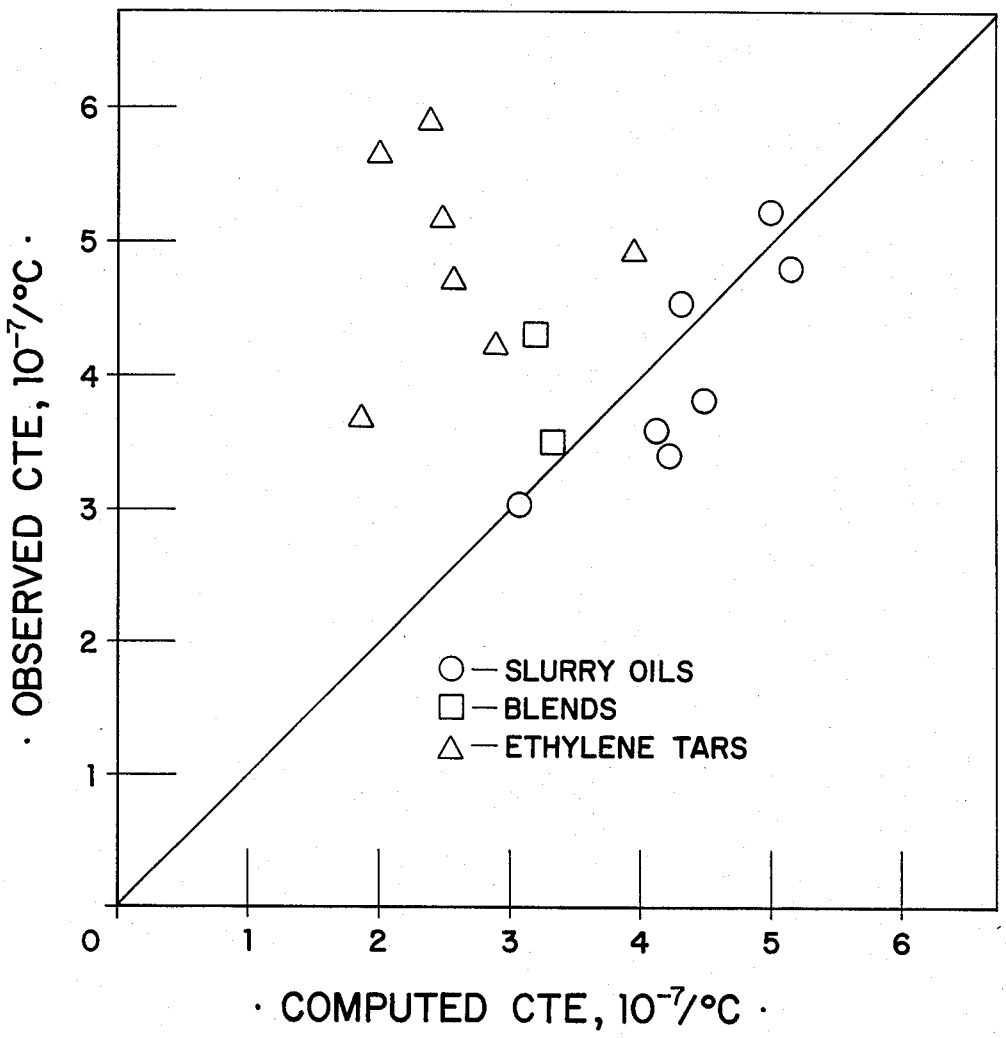
FIG. 2 shows the correlation of observed coke CTE with computed coke CTE for the samples in Table V, using the equation generated from NMR data for 17 slurry oils only.

FIG. 2 shows the correlation of observed coke CTE with computed coke CTE for the samples in Table V, using the equation generated from NMR data for 17 slurry oils only (Equation 8 from Table III). It may be seen that prediction of results was excellent for slurry oils but poor for ethylene tars and slurry oil-ethylene tar blends.

Figure 3:
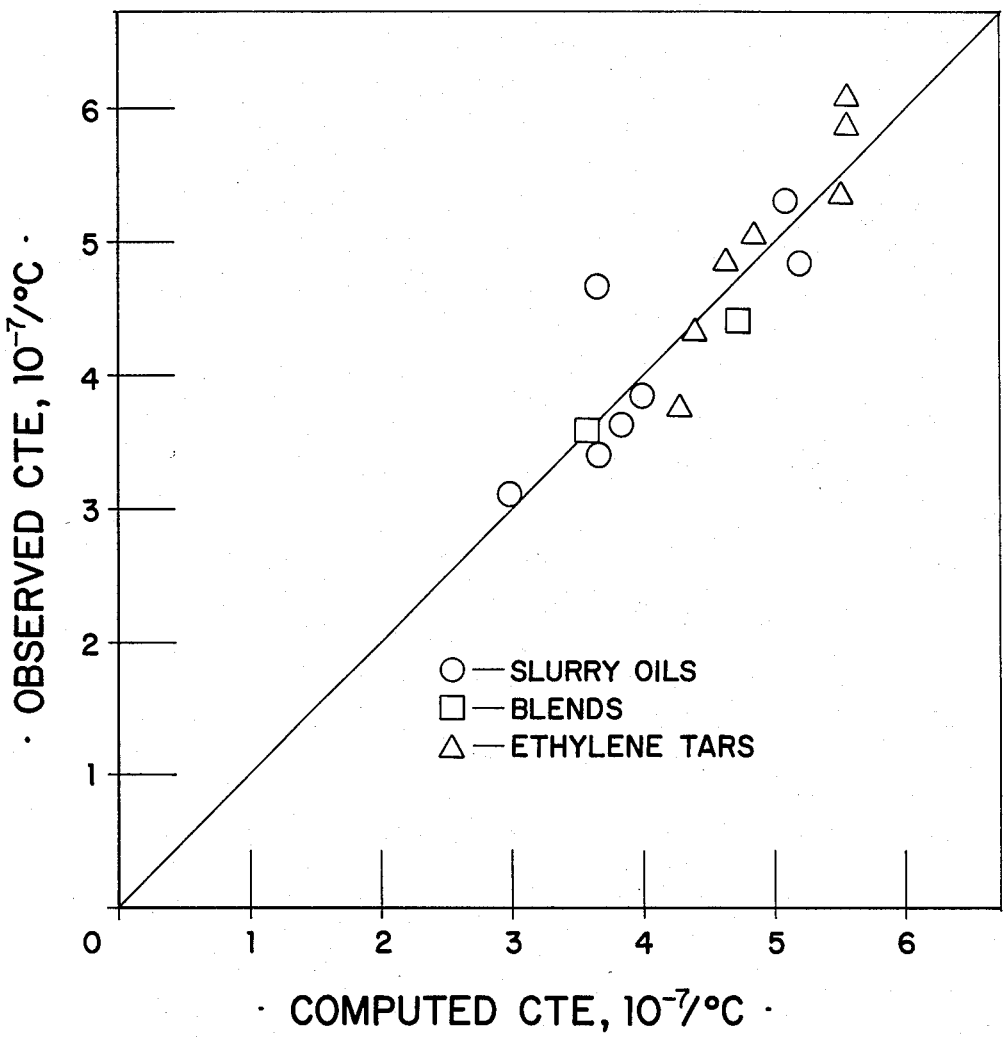
FIG. 3 shows the observed vs. computed coke CTE using both NMR and Q12 for the samples in Table V.

FIG. 3 shows the observed vs. computed coke CTE using both NMR and QI2 for the samples in Table V (Equation 4 of Table VI). It may be seen that the correlation is excellent.

It has been demonstrated in the foregoing that QI2 is a very useful correction variable, when used with NMR, in a mixed data base consisting of SO's, ET's and blends of the two. In order to determine whether correction variables were required in a data base consisting of ET's only, a further set of regression analyses was run on a subset of Table V, viz. case nos. 10–16. The resulting Equations 5, 6, and 7 are shown in Table VIII, and the compositions of the NMR variables of Table VIII are given in Table IX. Equation 5 of Table VIII illustrated that NMR analyses alone result in a good predictive equation, as was true when the data base was confined to SO's. However, it was found that the use of QI2 as a correction variable, with NMR, resulted in significant improvement in the quality of the correlation, while the use of SUS was not helpful.

The above data indicate that NMR data alone is usually sufficient to predict the CTE of a coked product of a single feedstock type, such as slurry oil or ethylene tar when analyzed by multiple linear regression analysis. However, NMR data alone is insufficient to predict CTE values accurately for data bases containing multiple feedstocks or mixtures, and the use of another factor is needed. Evaluation of viscosity and reactivity at elevated temperatures as shown by SUS and QI2 in the above shows that SUS viscosity is not very useful on either slurry oils or ethylene tars but that QI2 is highly useful as an independent variable in linear multiple regression analysis. Although QI2 as determined herein is the amount of quinoline insolubles formed in two hours at 450° C., some other measure of thermal reactivity could also be used, including variations in the time and temperature of the test and the method used to determine reactivity. Other solvents than quinoline may be useful and other measurements such as viscosity increase, calorimetric, or thermogravimetric analyses may also be useful.

TABLE I

DATA BASES FOR CORRELATION STUDY

| Case | Coke | Coking Feedstock | | | | | | | | Calculated | | |
|---|---|---|---|---|---|---|---|---|---|---|---|---|
| | | NMR Analysis | | | | | | | | Feedstock Parameters | | |
| No. | CTE | AR1 | AR2 | AL1 | AL2 | AL3 | C/H | SUS | QI2 | FA | SIGMA | NMRCTE |
| 1 | 4.2 | 2.0 | 16.6 | 17.6 | 43.3 | 20.5 | 0.761 | 53 | — | 0.465 | 0.396 | 4.3078 |
| 2 | 5.6 | 2.8 | 17.3 | 27.1 | 37.4 | 15.4 | 0.836 | 87 | — | 0.522 | 0.445 | 5.6252 |
| 3 | 4.6 | 2.8 | 21.5 | 26.2 | 33.1 | 16.4 | 0.869 | 59 | 5.7 | 0.564 | 0.394 | 4.2366 |
| 4 | 4.9 | 3.5 | 20.2 | 22.7 | 37.9 | 15.7 | 0.827 | 60 | — | 0.539 | 0.371 | 4.8381 |
| 5 | 3.8 | 2.7 | 23.3 | 25.7 | 32.8 | 15.5 | 0.866 | 61 | 9.7 | 0.539 | 0.372 | 4.0054 |
| 6 | 3.4 | 2.4 | 23.1 | 25.5 | 32.2 | 16.8 | 0.870 | 65 | 5.8 | 0.572 | 0.379 | 3.6668 |
| 7 | 4.3 | 4.7 | 27.1 | 32.2 | 24.8 | 11.2 | 0.977 | 47 | — | 0.651 | 0.361 | 4.3870 |
| 8 | 4.7 | 4.9 | 30.5 | 38.1 | 18.4 | 8.1 | 1.022 | 130 | — | 0.684 | 0.366 | 4.3777 |
| 9 | 3.1 | 6.5 | 33.8 | 30.1 | 19.9 | 9.7 | 1.022 | 47 | 2.4 | 0.708 | 0.293 | 3.2002 |
| 10 | 5.0 | 3.4 | 19.0 | 31.6 | 31.6 | 14.4 | — | 52 | — | — | — | 5.5106 |
| 11 | 5.0 | 3.0 | 21.8 | 31.2 | 29.0 | 15.0 | — | 59 | — | — | — | 4.5681 |
| 12 | 5.0 | 4.9 | 26.0 | 29.8 | 28.3 | 11.0 | — | 50 | — | — | — | 4.7511 |
| 13 | 5.3 | 1.9 | 16.2 | 18.6 | 44.8 | 18.5 | — | 72 | 10.0 | — | — | 4.9656 |
| 14 | 4.8 | 0.9 | 12.4 | 15.6 | 48.0 | 23.1 | — | 39 | 4.0 | — | — | 4.5886 |
| 15 | 4.3 | 3.0 | 25.8 | 29.0 | 31.0 | 11.2 | — | 57 | — | — | — | 4.5791 |
| 16 | 4.3 | 2.6 | 17.7 | 23.1 | 38.3 | 18.3 | — | 47 | — | — | — | 4.6882 |
| 17 | 3.9 | 7.3 | 31.4 | 32.6 | 19.0 | 9.7 | — | 50 | — | — | — | 3.9044 |
| 18 | 6.0 | 1.5 | 40.7 | 35.4 | 16.2 | 6.2 | — | 377 | 76.0 | — | — | 1.9181 |
| 19 | 3.7 | 1.3 | 50.5 | 41.0 | 6.1 | 1.1 | — | 238 | 66.5 | — | — | 0.7461 |

Data Base I — 17 Catalytic Slurry Oils (Case Nos. 1–17) From 8 Refineries.
Data Base II — 9 Catalytic Slurry Oils (Case Nos. 1–9) From 4 Refineries, For Which Both NMR And C/H Data Were Available For Calculation Of FA And SIGMA.

TABLE 2

BIVARIATE CORRELATION MATRIX FROM DATA BASE I

6 VARIABLES ARE IN CORRELATION MATRIX.
17 IS NUMBER OF OBSERVATIONS.

| Variable | Mean | Variance | Standard Deviation | Std. Error Of Mean | Coeff. Of Variation | CORRELATION MATRIX CTE | AR1 | AR2 | AL1 | AL2 | AL3 |
|---|---|---|---|---|---|---|---|---|---|---|---|
| CTE | 4.4824 | 0.44529 | 0.66730 | 0.16184 | 14.89% | 1.0000 | −0.3618 | −0.5496 | −0.1073 | 0.4089 | 0.2225 |
| AR1 | 3.4882 | 2.7824 | 1.6680 | 0.40456 | 47.82% | −0.3618 | 1.0000 | 0.8913 | 0.7326 | −0.8838 | −0.8661 |
| AR2 | 22.571 | 35.108 | 5.9252 | 1.4371 | 26.25% | −0.5496 | 0.8913 | 1.0000 | 0.7883 | −0.9499 | −0.9184 |
| AL1 | 26.865 | 35.545 | 5.9620 | 1.4460 | 22.19% | −0.1073 | 0.7326 | 0.7883 | 1.0000 | −0.9247 | −0.9096 |
| AL2 | 32.341 | 76.698 | 8.7577 | 2.1241 | 27.08 | 0.4089 | −0.8838 | −0.9499 | −0.9247 | 1.0000 | 0.9340 |
| AL3 | 14.735 | 17.059 | 4.1302 | 1.0017 | 28.03% | 0.2225 | −0.8661 | −0.9184 | −0.9096 | 0.9340 | 1.0000 |

TABLE III

MULTIPLE LINEAR REGRESSION ANALYSIS, CTE OF LABORATORY COKE AS A FUNCTION OF NMR ANALYSES OF SEVENTEEN CATALYTIC SLURRY OIL FEEDSTOCKS (DATA BASE I)

| Equation No. | Regression Equation Coefficients (Significance Level Of Coefficient, %) Intercept | AR1 | AR2 | AL1 | AL2 | AL3 | NMRCTE[1] | Correlation Criteria Coeff. Of Corr., R | Signif. Level, % | Std. Error Of Estimate |
|---|---|---|---|---|---|---|---|---|---|---|
| 1 | −14.0503 (97.37) | +0.37212 (99.14) | +0.02013 (23.01) | +0.28225 (99.96) | +0.28440 ( ) | | | 0.9060 | 99.98 | 0.3262 |
| 2 | 14.3896 (99.99) | +0.08772 (54.68) | −0.26427 (100.00) | −0.00215 (4.83) | | −0.28440 (99.59) | | 0.9060 | 99.98 | 0.3262 |
| 3 | 14.1747 (100.00) | +0.08987 (55.73) | −0.26212 (99.98) | | +0.00215 (4.83) | −0.28225 (99.96) | | 0.9060 | 99.98 | 0.3262 |
| 4 | −12.0377 (99.73) | +0.35199 (97.63) | | +0.26212 (99.98) | +0.26427 (100.00) | −0.02013 (23.01) | | 0.9060 | 99.98 | 0.3262 |
| 5 | 23.1613 (94.04) | | −0.35199 (97.63) | −0.08987 (55.73) | −0.08772 (54.68) | −0.37212 (99.14) | | 0.9060 | 99.98 | 0.3262 |
| 6 | 14.2615 (100.00) | +0.088779 (57.63) | −0.263805 (100.00) | | | −0.280589 (99.99) | | 0.9059 | 100.00 | 0.3144 |
| 7 | 14.3859 (100.00) | | −0.248494 (100.00) | | | −0.291470 (100.00) | | 0.9007 | 100.00 | 0.3099 |
| 8 | 0.0000 (100.00) | | | | | | +1.0000 (100.00) | 0.9059 | 100.00 | 0.2918 |

[1]NMRCTE = 14.2615 + 0.088779 AR1 − 0.263805 AR2 − 0.291470 AL3, from Equation No. 6

TABLE IV

MULTIPLE LINEAR REGRESSION ANALYSIS, CTE OF LABORATORY COKE AS A FUNCTION OF STRUCTURAL PARAMETERS OF NINE CATALYTIC SLURRY OIL FEEDSTOCKS (Data Base II), AND AS A FUNCTION OF NMR ANALYSES ONLY

| Equation No. | Regression Equation Coefficients (Significance Level Of Coefficient, %) Intercept | FA | SIGMA | NMRCTE | Correlation Criteria Coeff. Of Corr., R | Significance Level, % | Std. Error Of Estimate |
|---|---|---|---|---|---|---|---|
| 9 | 6.2590 (98.37) | −3.38113 (64.87) | | | 0.3531 | 64.87 | 0.7754 |
| 10 | −1.1560 (45.01) | | 14.5110 (97.93) | | 0.7470 | 97.93 | 0.5510 |
| 11 | −5.7528 (76.82) | +4.02953 (71.29) | +20.5047 (97.37) | | 0.7999 | 95.33 | 0.5372 |
| 12 | −0.3852 (53.11) | | | +1.08854 (100.00) | 0.9626 | 100.00 | 0.2247 |

TABLE V

DATA BASE FOR CORRELATION STUDY

| Case No. | Coke CTE | Feedstock Characteristics ET | SUS | QI2 | NMR Analysis AR1 | AR2 | AL1 | AL2 | AL3 |
|---|---|---|---|---|---|---|---|---|---|
| 1 (3) | 4.6 | 0.0 | 59 | 5.7 | 2.8 | 21.5 | 26.2 | 33.1 | 16.4 |
| 2 (5) | 3.8 | 0.0 | 61 | 9.7 | 3.5 | 21.8 | 25.2 | 34.1 | 15.4 |
| 3 (6) | 3.4 | 0.0 | 65 | 5.8 | 3.0 | 21.6 | 26.2 | 33.0 | 16.2 |
| 4 (9) | 3.1 | 0.0 | 47 | 2.4 | 6.5 | 33.8 | 30.1 | 19.9 | 9.7 |
| 5 (13) | 5.3 | 0.0 | 72 | 0.0 | 1.9 | 16.2 | 18.6 | 44.8 | 18.5 |
| 6 (14) | 4.8 | 0.0 | 39 | 4.0 | 0.7 | 11.0 | 16.5 | 49.4 | 22.4 |
| 7 | 3.6 | 0.0 | 62 | 26.4 | 6.0 | 16.0 | 32.0 | 23.0 | 13.0 |
| 8 | 3.6 | 0.25 | 86 | 24.4 | 1.8 | 27.7 | 32.6 | 23.8 | 14.1 |
| 9 | 4.4 | 0.50 | 92 | 54.7 | 2.6 | 32.1 | 34.7 | 19.8 | 10.8 |
| 10 (18) | 6.0 | 1.0 | 377 | 76.0 | 1.5 | 40.7 | 35.4 | 16.2 | 6.2 |
| 11 (19) | 3.7 | 1.0 | 238 | 66.5 | 2.6 | 48.0 | 39.4 | 8.2 | 1.8 |
| 12 | 4.3 | 1.0 | 106 | 65.9 | 0.0 | 38.3 | 37.6 | 17.6 | 6.5 |

TABLE V-continued

DATA BASE FOR CORRELATION STUDY

| Case No. | Coke CTE | Feedstock Characteristics ET | SUS | QI2 | NMR Analysis AR1 | AR2 | AL1 | AL2 | AL3 |
|---|---|---|---|---|---|---|---|---|---|
| 13 | 4.8 | 1.0 | 186 | 82.2 | 0.0 | 37.8 | 42.6 | 11.5 | 8.1 |
| 14 | 5.0 | 1.0 | 124 | 78.6 | 4.1 | 35.1 | 39.2 | 15.8 | 5.8 |
| 15 | 5.3 | 1.0 | 134 | 77.7 | 4.0 | 43.0 | 36.4 | 12.6 | 4.0 |
| 16 | 5.8 | 1.0 | 136 | 72.7 | 4.4 | 48.0 | 34.4 | 11.9 | 1.3 |

TABLE VI

CORRELATION OF COKE CTE WITH FEEDSTOCK PROPERTIES MULTIPLE LINEAR REGRESSION ANALYSIS

| No. | Regression Equation | Correlation Criteria R | Std. Error |
|---|---|---|---|
| 1 | CTE = 10.4735 + NMR1 (96.22%) (99.45%) | 0.6587 | 0.6853 |
| 2 | CTE = 32.7549 + NMR2 + 5.1930 ET (99.99%) (99.97%) (99.99%) | 0.8636 | 0.4766 |
| 3 | CTE = −2.7247 + NMR3 + 0.00442 SUS (81.78%) (98.31%) (95.93%) | 0.7207 | 0.6653 |
| 4 | CTE = 11.5087 + NMR4 + 0.05268 QI2 (100.00%) (100.00%) (100.00%) | 0.9038 | 0.4044 |

TABLE VII

COMPOSITION OF NMR VARIABLES USED IN REGRESSION EQUATIONS OF TABLE II

| Variable | Coefficients of Individual NMR Bands AR2 | AL1 | AL2 | AL3 |
|---|---|---|---|---|
| NMR1 | +0.1400 | +0.1712 | +0.2713 | −0.1160 |
| NMR2 | −0.2485 | −0.4769 | −0.3605 | +0.0530 |
| NMR3 | +0.3031 | +0.1034 | +0.1966 | −0.2033 |
| NMR4 | −0.0142 | −0.2420 | −0.0722 | +0.0553 |

TABLE VIII

CORRELATION OF COKE CTE WITH FEEDSTOCK PROPERTIES MULTIPLE LINEAR REGRESSION ANALYSIS

| No. | Regression Equation | Correlation Criteria R | Std. Error |
|---|---|---|---|
| 5 | CTE = 48.6381 + NMR5 | 0.9330 | 0.2933 |
| 6 | CTE = 48.5276 + NMR6 + SUS | 0.9334 | 0.3566 |
| 7 | CTE = −52.9251 + NMR7 + QI2 | 0.9947 | 0.2035 |

TABLE IX

COMPOSITION OF NMR VARIABLES USED IN REGRESSION EQUATIONS OF TABLE II

| Variable | Coefficients of Individual NMR Bands AR2 | AL1 | AL2 | AL3 |
|---|---|---|---|---|
| NMR5 | −0.2775 | −0.7065 | −0.5057 | +0.2910 |
| NMR6 | −0.2816 | −0.7001 | −0.5014 | +0.2759 |
| NMR7 | +0.4690 | +0.3649 | +0.7149 | −0.1373 |

FIG. 1 illustrates the excellent correlation of observed CTE with computed CTE for the 17 slurry oils, and poor correlation for the 2 ethylene tars, when NMR analyses only are used in the regression equation.

Variations in analytical and coking equipment and procedures may result in slightly different data, giving rise to slightly different regression equations. It is expected, however, that reproducible data will result in reliable regression equations when subjected to the multiple linear regression analysis technique described herein, even if (when) those equations differ somewhat from the examples cited in the claims.

While CTE as used herein is defined as the CTE using 2 pph iron oxide as a puffing inhibitor, other puffing inhibitors including $Cr_2O_3$ and $CaF_2$ may be used, and in low sulfur cokes the use of a puffing inhibitor may be unnecessary.

I claim:

1. In a process for the selection of a feedstock or blend of feedstocks selected from the group consisting of catalytic slurry oils and ethylene pyrolysis tars to be coked in a delayed coker for the production of a premium needle coke having a graphite CTE characteristic of not more than $5\times10^{-7}$ cm/cm/°C. over the range of 0° to 50° C. from petroleum-based coker feedstock, the improvement comprising the steps of:

(1) Performing an analysis by high resolution nuclear magnetic spectroscopy on said feedstock to determine the values for the bands AR1, AR2, AL1, AL2, and AL3 as a percentage wherein AR1 denotes aromatic hydrogen atoms of the polycyclic type, primarily "bay protons," AR2 denotes aromatic hydrogens of the benzenoid type, AL1 denotes aliphatic hydrogens of the benzylic type, AL2 denotes aliphatic hydrogens of the methylene type, and AL3 denotes aliphatic hydrogens of the methyl type, respectively, wherein the total of said AR1, AR2, AL1, AL2 and AL3 percentages is 100%;

(2) Selecting said feedstock or blend of said feedstocks to have a coked product CTE of not more than $5\times10^{-7}$ cm/cm/°C. as predicted by an equation derived by multiple linear regression analysis of the said values as independent variables for a statistically significant number of said feedstocks independently determined by laboratory coking to produce said premium needle cokes when coked in a delayed coker, said equation being in the form of CTE=K+NMR, where CTE is the coefficient of thermal expansion of the coked product, K is a constant, NMR is defined as value given by the equation expressing any four of the said values for AR1, AR2, AL1, AL2, and AL3 as determined by NMR and expressed by the equation in the form $NMR=b_1x_1+b_2x_2+b_3x_3+b_4x_4$, where $b_{1\text{-}4}$ are the coefficients of any four of the individual bands for hydrogen AR1, AR2, AL1, AL2, and AL3, and $x_{1\text{-}4}$ are the same four values of the said NMR bands.

2. The process of claim 1 wherein an additional factor related to the thermal reactivity of the feedstock is used as an independent variable in multiple linear regression analysis.

3. The process of claim 1 wherein an additional factor denoting the amount of quinoline insoluble matter formed during a heat treatment for two hours at 450° C. is used as an independent variable in multiple linear regression analysis.

4. The process of claim 1 wherein the equation derived is CTE=48.6381−0.2775 AR2−0.7065 AL1−0.5057 AL2+0.02910 AL3.

5. The process of claim 1 wherein the equation derived is CTE=−52.9251+NMR+0.2113 QI2, where NMR=0.4690 AR2+0.3649 AL1+0.7149 AL2−0.1373 AL3.

6. The process of claim 1 wherein the feedstock is ethylene pyrolysis tar.

7. The process of claim 1 wherein the feedstock is catalytic slurry oil.

* * * * *